US008287672B2

(12) United States Patent
Neeser et al.

(10) Patent No.: US 8,287,672 B2
(45) Date of Patent: Oct. 16, 2012

(54) STRAPPING DEVICE

(75) Inventors: Mirco Neeser, Ennetbaden (CH); Flavio Finzo, Würenlos (CH)

(73) Assignee: Illinois Tool Works Inc., Glenview, IL (US)

( * ) Notice: Subject to any disclaimer, the term of this patent is extended or adjusted under 35 U.S.C. 154(b) by 505 days.

(21) Appl. No.: 12/527,144

(22) PCT Filed: Feb. 14, 2008

(86) PCT No.: PCT/IB2008/000339

§ 371 (c)(1),
(2), (4) Date: Aug. 25, 2009

(87) PCT Pub. No.: WO2008/099274

PCT Pub. Date: Aug. 21, 2008

(65) Prior Publication Data

US 2010/0107573 A1 May 6, 2010

(30) Foreign Application Priority Data

Feb. 14, 2007 (CH) ..... 0239/07

(51) Int. Cl.
*B32B 37/00* (2006.01)

(52) U.S. Cl. ..... 156/73.5; 156/494; 156/579; 156/580; 100/32; 100/33 PB

(58) Field of Classification Search ..... 156/64, 156/73.1, 73.5, 229, 494, 579, 580, 580.1; 100/32, 33 PB; 53/375.9, 582, 590, 592
See application file for complete search history.

(56) References Cited

U.S. PATENT DOCUMENTS

| | | | | |
|---|---|---|---|---|
| 4,479,834 | A | 10/1984 | Kobiella | |
| 5,653,095 | A * | 8/1997 | Stamm | 53/592 |
| 6,308,760 | B1 * | 10/2001 | Finzo et al. | 156/494 |
| 6,848,241 | B2 * | 2/2005 | Lopez | 53/589 |
| 7,497,068 | B2 * | 3/2009 | Nasiatka et al. | 53/582 |

FOREIGN PATENT DOCUMENTS

CN 2494316 Y 6/2002

(Continued)

OTHER PUBLICATIONS

International Report on Preliminary Examination dated Nov. 17, 2009 for PCT/IB2009/000339.

(Continued)

*Primary Examiner* — James Sells
(74) *Attorney, Agent, or Firm* — Levenfeld Pearlstein, LLC

(57) ABSTRACT

The invention relates to a portable strapping device to strap packaged goods using a strapping band, the device comprising a tightening mechanism for applying tension to a loop of a strapping band, a frictional welding element (5) to generate a friction weld connection of two overlapping strapping-loop segments, and a rechargeable energy-storing device (10) for storing energy, in particular mechanical, elastic or potential energy that may be released as drive energy applied to a frictional welding system (5) to produce a frictional weld connection. One objective of the invention is to attain applicability, in the absence of an electric storage battery, at the highest possible efficiency, to such an above described portable strapping device. This objective is attained in that the energy storage (10) may be loaded using a manually triggered drive component and in that, when energy stored in the storage is released, the energy storage carries out a displacement devoid of any reversal of motion.

15 Claims, 7 Drawing Sheets

FOREIGN PATENT DOCUMENTS

| | | | |
|---|---|---|---|
| CN | 2526260 | Y | 12/2002 |
| CN | 2528710 | Y | 1/2003 |
| CN | 2692032 | Y | 4/2005 |
| EP | 0664256 | | 7/1955 |
| EP | 1413519 | A1 | 10/2003 |
| FR | 2193693 | | 2/1974 |
| GB | 2055740 | | 3/1981 |

OTHER PUBLICATIONS

International Search Report for PCT/IB2008/000339.

* cited by examiner

STRAPPING DEVICE

The invention relates to a portable strapping device to strap packaged goods using a strapping band, the device comprising a tightening mechanism for applying tension to a loop of a strapping band, a frictional welding element to produce a friction-welding connection of two overlapping strapping-loop segments, and a rechargeable energy accumulator for storing energy, in particular mechanical, elastic or potential energy that may be released as drive energy applied to a frictional welding system to produce a frictional weld connection.

Strapping devices of this type are designed for a mobile use, in which the devices are carried by the user to the actual place of use and are not dependent on energy supplied from external sources. The energy required for the intended use of such strapping devices, i.e., for tightening and producing a weld connection is usually provided by an electrical battery or by compressed air. Using this energy the tightening mechanism tightens the strapping band and then a connection is produced. Strapping devices of this type are also designed to connect exclusively plastic-material bands.

Essentially, two types of connection are known in association with mobile strapping devices. With the first type of connection, a sealing element is first placed on the ends of the overlapping bands and the connection is achieved by forming the sealing element. To produce such connections, essentially a force generated manually by means of a hand lever is used in that it is applied directly on the sealing element. With the second type of connection of this nature, essentially no external material like a sealing element is used; instead, the band ends are heated up causing their local melting and during a subsequent cooling-off both ends are permanently connected. To produce such connections of the second type, in practical application associated with mobile devices only frictional welding is used, in which a welding shoe of the strapping device is pressed against one of the band ends and sets it into an oscillating movement. The friction thus produced between the welding shoe and the band end melts the two superimposed band ends and, during the subsequent cooling-off, the two band ends connect to each other.

A disadvantage of typical batteries used for such frictional welding devices may be that the mobile strapping device can no longer be used when the battery is empty. If the pertinent user has no replacement battery at hand, or if he forgot to recharge a second battery, and there is no other opportunity to charge the battery locally, the strapping device is not functional.

DE-PS 1 912 048 discloses a strapping device, in which the energy required for the frictional welding process is stored in a torsion bar. When a locking mechanism is released, the torsion bar starts moving to and fro. This oscillating movement is transmitted directly onto the frictional welding shoe, which makes an oscillating movement of the same frequency as the torsion bar and produces a frictional welding connection. One disadvantage of this device may be that it requires a relatively high portion of lost energy, which must be procured and stored in the torsion bar but is not available for the actual production of the frictional welding connection.

Therefore, the technical task of the invention is to design a strapping device of the type mentioned at the beginning, in such a manner that it can be used with high efficiency and in particular also without any battery.

This task is resolved by providing a strapping device in which the energy-storing device can be re-charged by means of a manually operated operating device and, when releasing energy stored in the energy-storing device, the energy-storing device moves without changing its orientation. The manually re-chargeable energy-storing device of the strapping device can be designed to store mechanical, elastic or potential forms of energy that can then be released as the driving energy of the frictional welding device to produce a frictional welding connection. In addition, this technical task is fulfilled by a method in which in order to produce a frictional welding connection, in two positions of a strapping band, in particular on a strapping band that is formed as a band loop, the frictional welding devices of a mobile portable strapping device is supplied with a driving movement that generates an oscillating movement of a welding device that is in contact with the strapping band, and in which the energy required to produce the frictional welding connection is transmitted to the strapping device by means of manual operation of an operating device, for example, a hand lever, is then temporarily stored in an energy-storing device of the strapping device, and, upon actuating a release device, is transmitted from the energy-storing device to the frictional welding device.

The invention includes the process, in which after the release of the energy-storing device, the energy that is temporarily stored in it is released in the form of a driving movement, which—differently, for example, from the device of the DE-PS 1 912 048 mentioned at the beginning—can function without any change of orientation, in particular without a number of changes in orientation. This allows to eliminate the kinetically disadvantageous dead point positions of the driving movement itself, during which no torque can be provided for the frictional welding device. Unlike the device of DE-PS 1 912 048, the frictional welding shoe as designed by the invention is supplied, in particular at the moments of its reversal in its oscillating movement, continually with a torque that allows a high acceleration from the dead-point positions. Thus, no energy is required to overcome the inertia moment of the torsion bar in the area of the dead-point positions of the energy-storing device itself. This creates conditions for providing a higher efficiency in the conversion of the stored energy into thermal energy in the area of the welding spot as compared with the current state of the art.

Based on this design, the invention responds in an especially advantageous manner to the circumstance that the production of frictional welding connections requires to creating and/or maintaining quite specific conditions. It has been demonstrated that, in particular high-load frictional welding, connections can only be achieved with repetitive accuracy if simultaneously certain parameter ranges for the contact pressure of the frictional welding shoe on the strapping band and the frequency of the oscillating movement of the frictional welding shoe are maintained during a certain period of action. These parameter ranges can still vary due to external circumstances, for example, the particular type of plastic material or the quality of the contact area surface of the frictional welding shoe.

Parameter ranges suitable for motor-driven frictional welding devices are well known to a person skilled in the art.

However, in connection with the invention it turned out that with a manual direct operation of a frictional welding device it is very difficult to maintain these parameter ranges and definitely not with a repetitive accuracy. Therefore, the invention proposes to temporarily store—at least for a short period of time—the manually, i.e., not by means of a motor, provided energy in the strapping device and then to retrieve it in essentially predetermined, preferably constant and dead-point-free driving movement of the energy-storing device. This makes it possible to utilize the force or rather energy provided by a user with a high degree of efficiency in a pre-determined manner, which in its turn allows achieving high-quality frictional welding connections with repetitive accuracy. Under the expression "in a pre-determined manner" we can preferably understand an energy release, in which for the purpose of frictional welding processes, a pre-determined (possibly also adjustable) constant or variable force is supplied to the frictional welding device over a certain period of time. In a preferred embodiment, the energy that exits the energy-storing device is first transmitted to a drive device of the strapping device as a released tightening energy or tightening work (for example, a displacement of a spring end along a path). Using the drive device, an oscillating movement should be generated for the frictional welding shoe, by which the frictional welding shoe is moved to and fro while pressing against a strapping band to produce a frictional welding connection. Such a drive device can generate the oscillating movement for the frictional welding shoe, for example, by means of an eccentric.

Such a construction-wise especially advantageous and still very reliable and maintenance-free preferred solution with a long service life can thus comprise a mechanical, elastically deformable spring as a component of the energy-storing device. In general, any type of spring is suitable in connection with the energy-storing device. Such a solution has an additional advantage that the energy provided by the user can reach the energy-storing device as the spring energy, be stored there and released again without substantial losses.

A technically especially reliable and robust solution can be obtained when the energy-storing device releases the energy that is stored in it preferably by means of an at least approximately linear movement to the drive device. The drive device can be designed in such a way as to transform the originally linear motion into an oscillating motion. Instead of a preferred linear motion, also a different driving motion, at least essentially constant, continuous and/or dead-point-free driving motion of the energy-storing device can be provided, for example, a driving motion along a curved motion path.

In a preferred embodiment, the energy-storing device can be actively connected to the drive device—and thus also to the frictional welding device—by means of a contact element, for example, a toothed belt, a V-belt, a chain or a similar device in order to transmit the force available over a certain period of time in direction to the frictional welding shoe. The contact element can preferably conduct energy both for recharging the energy-storing device and for releasing energy. In an especially useful embodiment, the contact element can be moved in mutually opposite directions.

In another preferred embodiment, a speed change (to a higher gear) of a rotational motion occurs in the drive device, which, in relation to the energy flow, can be located between the energy-storing device and the frictional welding shoe. The thus achieved higher angular velocity can be used to provide a maximum high translational speed of the frictional welding shoe. For this purpose, the drive device can be equipped with a planetary transmission, in particular a belt or chain drive. An especially high translation can be achieved, for example, in that an exit-side shaft of the planetary transmission provides an input-side rotational motion. Of course, many other types of transmissions alone or in a combination can be used to transform the motion provided by the energy-storing device into a motion that is suitable for the frictional welding device.

Furthermore, the technical task is fulfilled by means of a strapping device in which at least one planetary transmission—in relation to the path of the driving energy for the frictional welding device in the strapping direction—is arranged between a place of introduction of the driving motion and a frictional welding element of a frictional welding device that is in oscillating motion for the production of the frictional welding connection. Such a planetary transmission allows achieving especially high gear or reduction ratios of a driving rotational motion with a very small number of components and thus conducting the driving motion to the frictional welding device with a very low loss. This advantage can be used both with manually generated and motor-generated driving motion. This advantage can be further improved in a preferred embodiment of the strapping device, in which—in addition to at least one planetary transmission—an enveloping transmission with an endless contact element, such as especially a toothed belt is arranged in the drive train of the frictional welding device, and the enveloping transmission is preferably actively connected, at the input side, to the at least one planetary transmission and, at the output side, to the frictional welding device.

In addition, in connection with the strapping device as designed by the invention, a switch element, in particular a switch button can be useful, when its actuation can lead the driving motion introduced into the strapping device either in the direction to the tightening device or to the at least one planetary transmission.

Further preferred embodiments of the invention result from the claims, the description, and the drawing.

The invention will now be explained in more detail using examples of embodiments that are shown in the figures in a purely schematic manner:

FIG. 1 shows an example embodiment of a manually operated strapping device as designed by the invention.

FIG. 2 a perspective drawing of the tightening device and the frictional welding device of the strapping device from FIG. 1.

Figure 1:
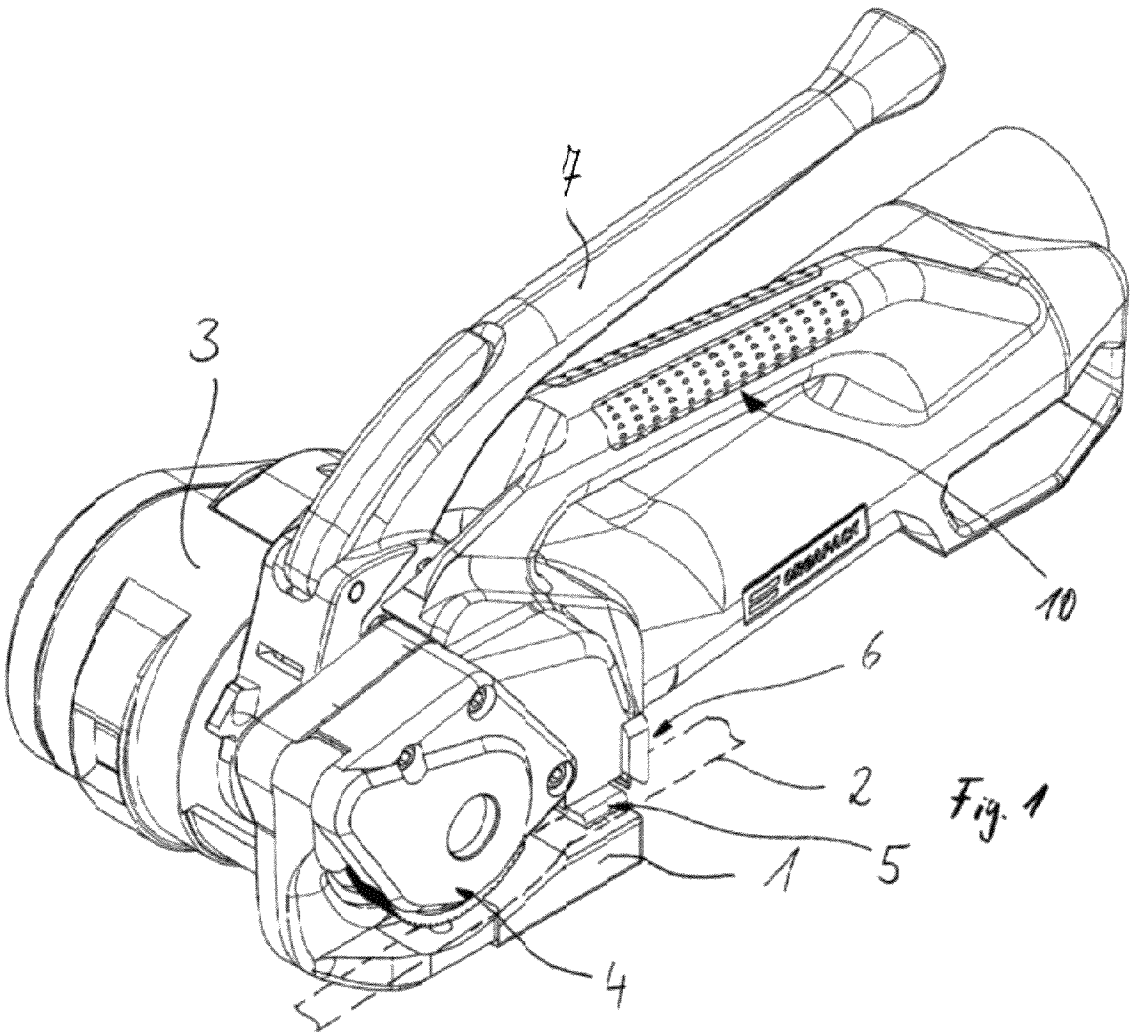
Figure 2:
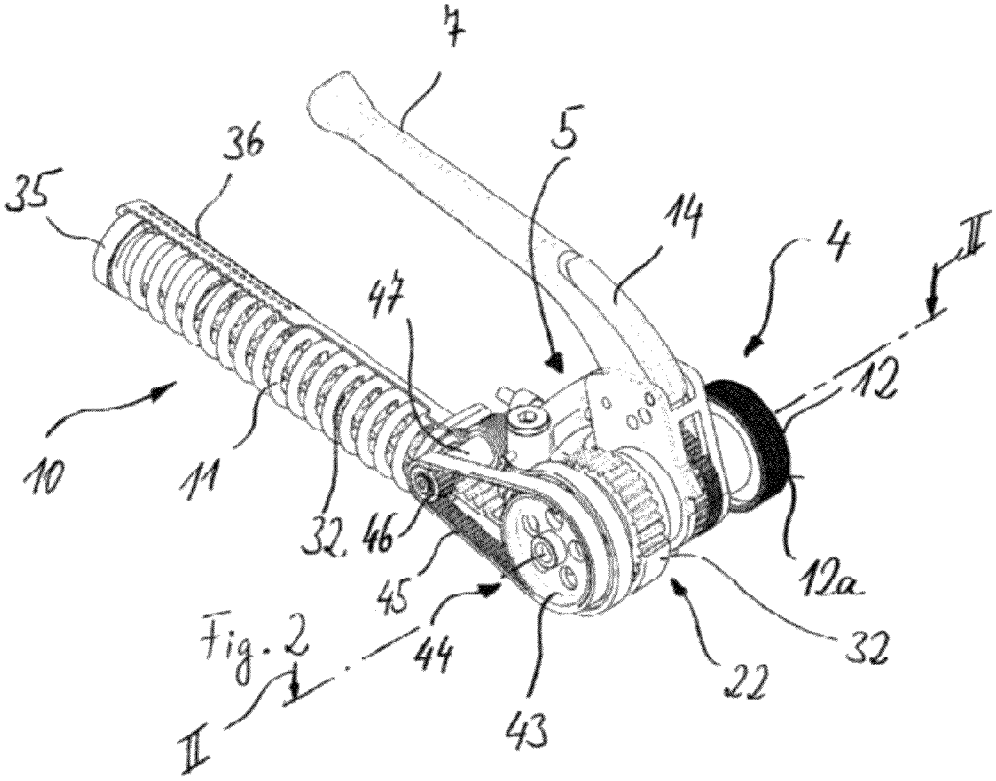
Figure 3:
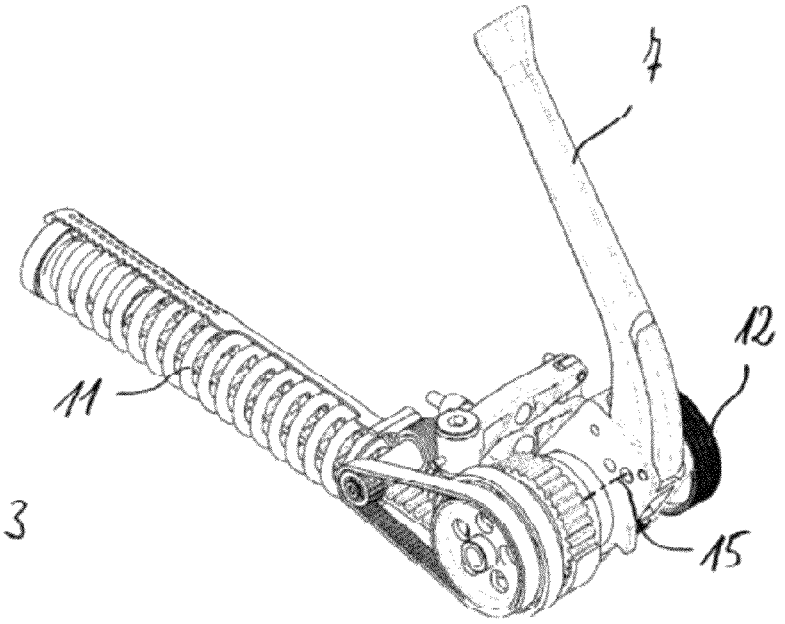
FIG. 3 shows the tightening device and the frictional welding device from FIG. 2 in another position.

The manually portable and thus mobile strapping device shown in FIG. 1 is designed to strap any packed goods with a plastic-material band. In the representation in FIG. 1, we can recognize a base plate 1 of the strapping device, which on the one hand serves as a handle for individual mechanical components of the strapping device and, on the other, as a base for a two-layer section of the strapping band 2, which is introduced into the frictional welding device to produce a frictional welding connection. However, the drawing in FIG. 2 shows with an intermittent line only one layer of the strapping band 2. In addition, in FIG. 1 a case 3 of the device hides the mentioned mechanical components.

To better illustrate the mechanical components of the device, the device is shown in FIGS. 2 to 10 without the case. As one can infer from these drawings, the strapping device comprises, in a manner basically known in the state of the art, a tightening device 4, a frictional welding device 5 and a separation unit 6 (FIG. 1). The example embodiment all these devices are designed without any motor and are driven only by a manually generated energy. The tightening device 4 and the frictional welding device 5 will subsequently be explained in more detail. Since the separation unit 6 can be taken over from other strapping devices in a well-known design, we will not explain it in any more detail.

The energy required for the tightening device 4 and the separation unit 6 is conducted directly to the provided device components that are designed to perform action on the strapping band, i.e., the energy is transmitted through a manually operated hand lever 7 without any temporary storage. In contrast the welding device comprises an energy-storing device 10, which in the example embodiment comprises a coil spring 11 that is arranged in the handle of the device. The energy generated over a period of time is stored in a temporary energy-storing device and it can—as will be subsequently explained in more detail—be retrieved some time after its manual generation. In other embodiments of the invention, an energy-storing device could also be provided for the tightening device and/or the separation unit, possibly the same as that designed for the frictional welding device. As well, in addition to a battery, such a mechanical energy-storing device could be provided, which would be destined only an emergency when no electrical power is available.

The tightening device 4 comprises a tensioning wheel 12 that can rotate around a rotation axis; the wheel's circumferential surface 12*a* is designed in the form of a rubbing surface. The rubbing surface 12*a* is designed to be in contact with a strapping band. When the rubbing surface 12*a* is pressed against a strapping band with a simultaneous rotational motion of the tensioning wheel 12, a retraction movement of one layer of the strapping band is generated. Then, a band loop that forms itself and is placed around the goods to be packed can be tightened in a per se well-known manner.

The strapping device is equipped with a switch button 14, which is attached to the hand lever in a pivoting mount. Using the switch button 14, one can transmit the energy flow exiting the hand lever 14 to various device components. Using the switch button 14, the hand lever 7 can be actively connected especially to the tensioning wheel. The hand lever 7 is mounted in such a manner that it can pivot around a pivot axis 15 (FIG. 3) so that the hand lever 7 is designed to perform pivoting movements over a certain angular range between two end positions. To establish an active connection, using the switch button 14 one can actuate a first ratchet pawl 16 (FIG. 8), which consequently engages in a clutch 18. The clutch 18 is designed approximately as a hollow cylinder, where a longitudinal and rotational axis 19 of the clutch extends vertically to the plane, in which the pivoting movements of the hand lever 7 are carried out. An external surface 18*a* of the clutch 18 is equipped with a toothing, which is not visible in the figures, and into which the ratchet pawl 16 engages after its actuation by the switch button 14 and so connects the hand lever 7 to the clutch in a detachable manner. The clutch works through a rubbing surface 18*b* of a hollow cone against a rubbing surface 12*b* of an external cone of the tensioning wheel 12. By means of a spring pack 20, the two rubbing surfaces 12*b* and 18*b* are pressed toward each other, which can create good cohesive friction between the two rubbing surfaces. With a corresponding position of the switch button 14, a pivoting movement of the hand lever 7 results in a rotational motion of the tensioning wheel 12 around the longitudinal axis 19.

Figure 4:
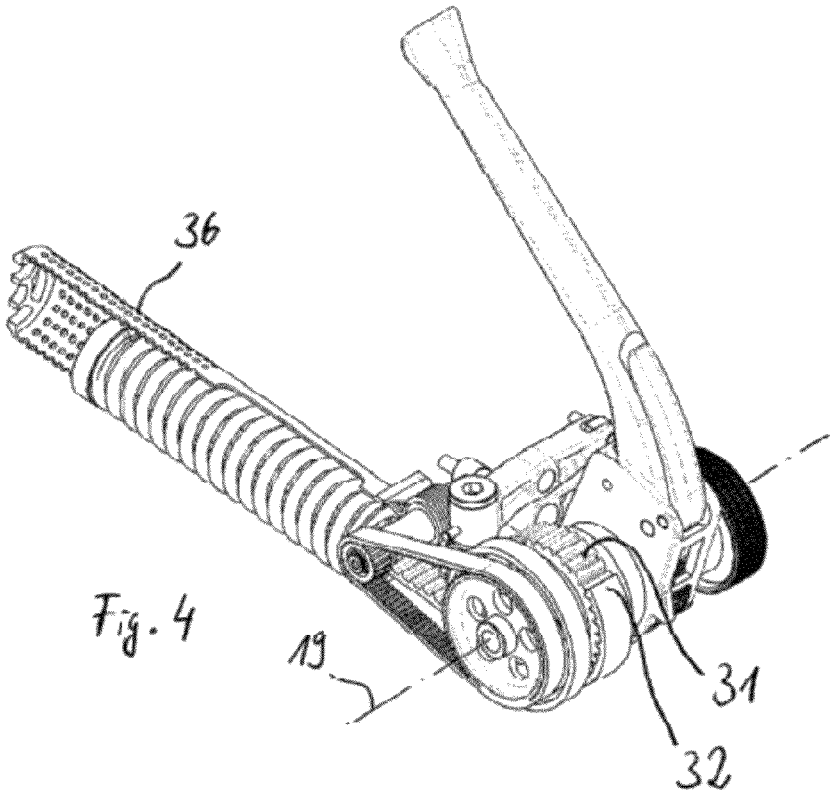
FIG. 4 shows the tightening device and the frictional welding device from FIGS. 2 and 3 in yet another position.
Figure 5:
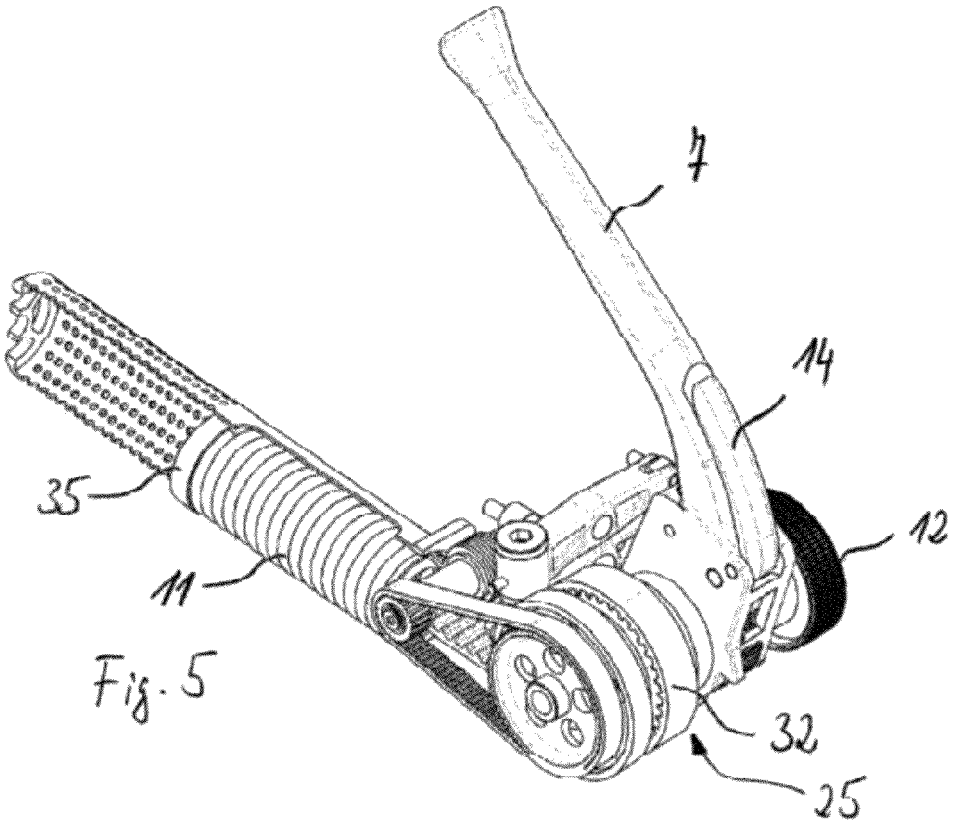
FIG. 5 shows the tightening device and the frictional welding device from FIGS. 2 to 4 in yet another position.
Figure 6:
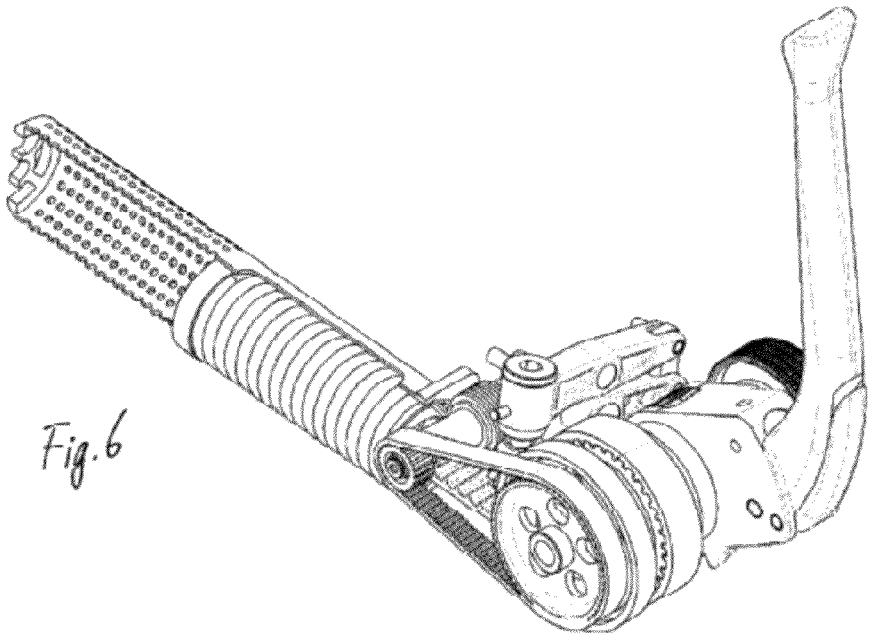
FIG. 6 shows the tightening device and the frictional welding device from FIGS. 2 to 5 in yet another position.
Figure 7:
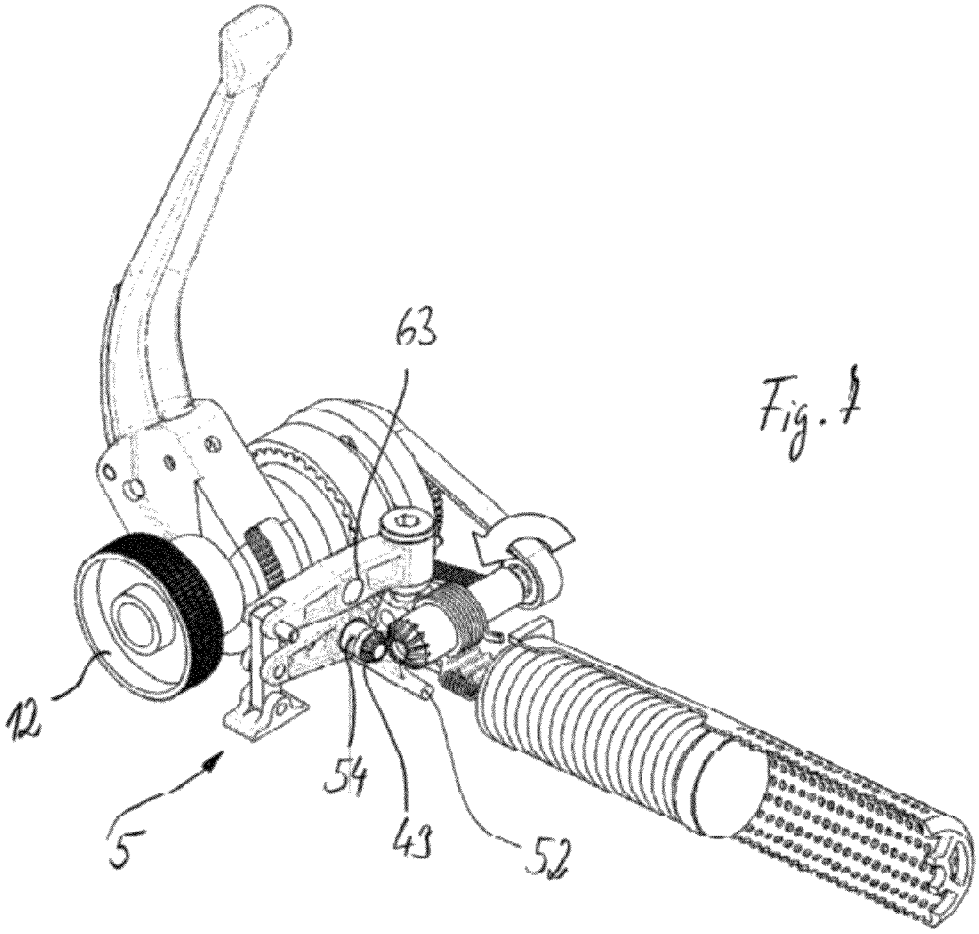
FIG. 7 shows the tightening device and the frictional welding device from FIGS. 2 to 6 in a different perspective.

With another position of the switch button 14, the hand lever 14 can be actively connected, by a second ratchet pawl 21 (FIG. 8), to the transmission device 22 of the strapping device that is assigned to the frictional welding device 5 and the energy-storing device 10. As can be recognized especially in FIG. 8, the transmission device 22 in the displayed embodiment of the invention comprises a first planetary transmission 25, which has a rotational axis, which is identical to the longitudinal axis 19 of the tensioning wheel 19. The planetary transmission is—in relation to an axial direction of the longitudinal axis 19—offset in relation to the tensioning wheel 12, and comprises a sun gear 26, into whose external toothing 27 engages the ratchet pawl 21. The planet gears 28 of the planetary transmission 25 engage into a toothing of the sun gear 26. In addition, the planet gears 28 are in engagement with an internal toothing 29 of a hollow wheel that functions as a loading wheel. On an external surface 31 of the loading wheel 30, there is designed a further toothing, into which engages the mating toothing of a toothed belt 32. One end of the toothed belt 32 is attached to a place in the external surface 31 of the loading wheel 30 (FIG. 4).

As you can see in FIGS. 2 to 7, the other end of the toothed belt 32 is conducted through the coil spring 11 and is arranged on its end that is opposite to the planetary transmission 25. For this purpose, a disk-like cover 35 is set on this end of the coil spring 11, to which the toothed belt 32 is attached with its end. The coil spring 11 is mounted in a cylindrical case 36. Suitable coil springs 11 can have, for example, a spring rate of within the range from 15 N/mm to 30 N/mm, as well as a spring force of 1,500 N to 2,200 N.

Figure 8:
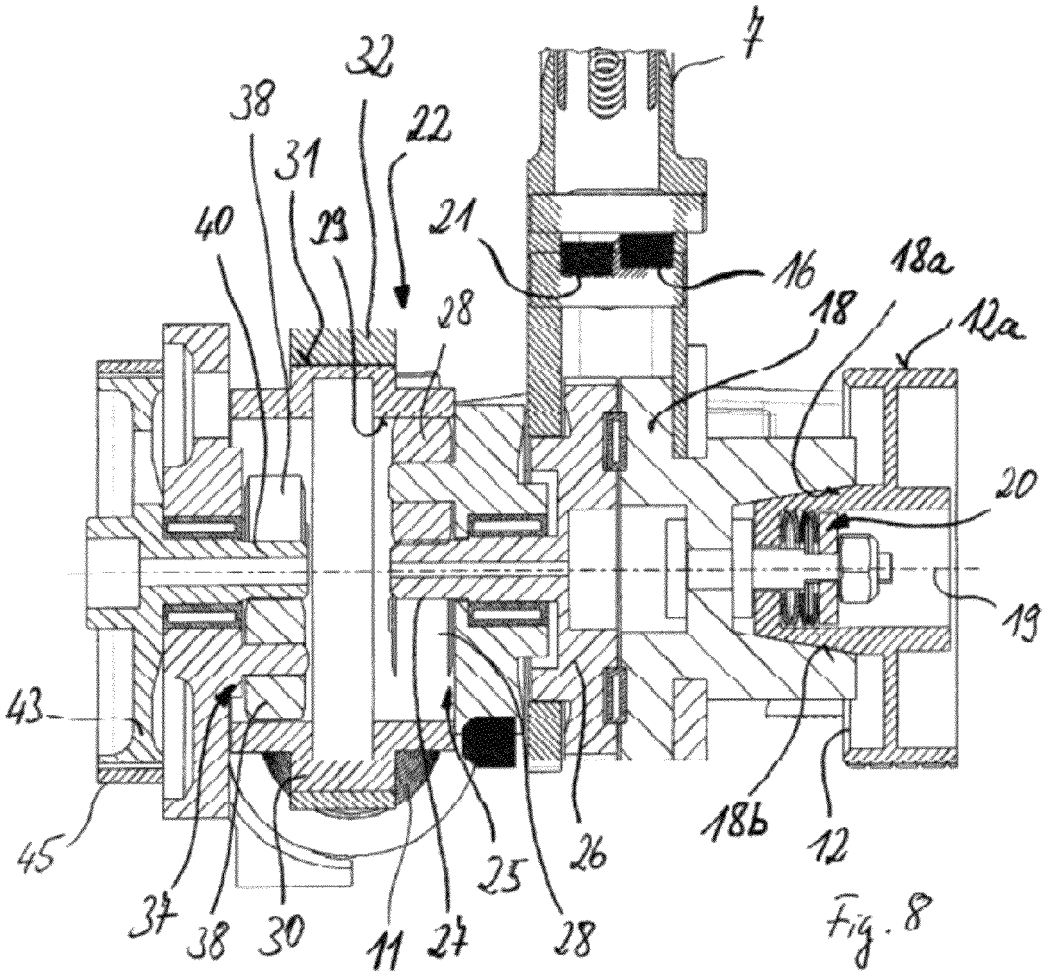
FIG. 8 shows a cross-section along the line II-II from FIG. 2.

Another planetary transmission 37 is connected laterally from the loading wheel along the longitudinal axis 19 (FIG. 8). Its planet gears 38 engage into a second internal toothing 39 of the loading wheel 30 and transmit its motion to a sun gear 40 of the planetary transmission 37. The sun gear 40 also rotates around the longitudinal axis 19 and is mounted in a static case component 41 by means of a roller bearing. The sun gear 40 is connected, as one part, to wheel 43 with external toothing, which is part of a toothed belt transmission 44. Though the planet gears 38 that are arranged on the journal pin of the case part 41, the rotational motion of the loading wheel 30 thus causes the gear wheel 43 to rotate due to the planet gears 38 being engaged in a toothing of the sun gear 40.

Figure 9:
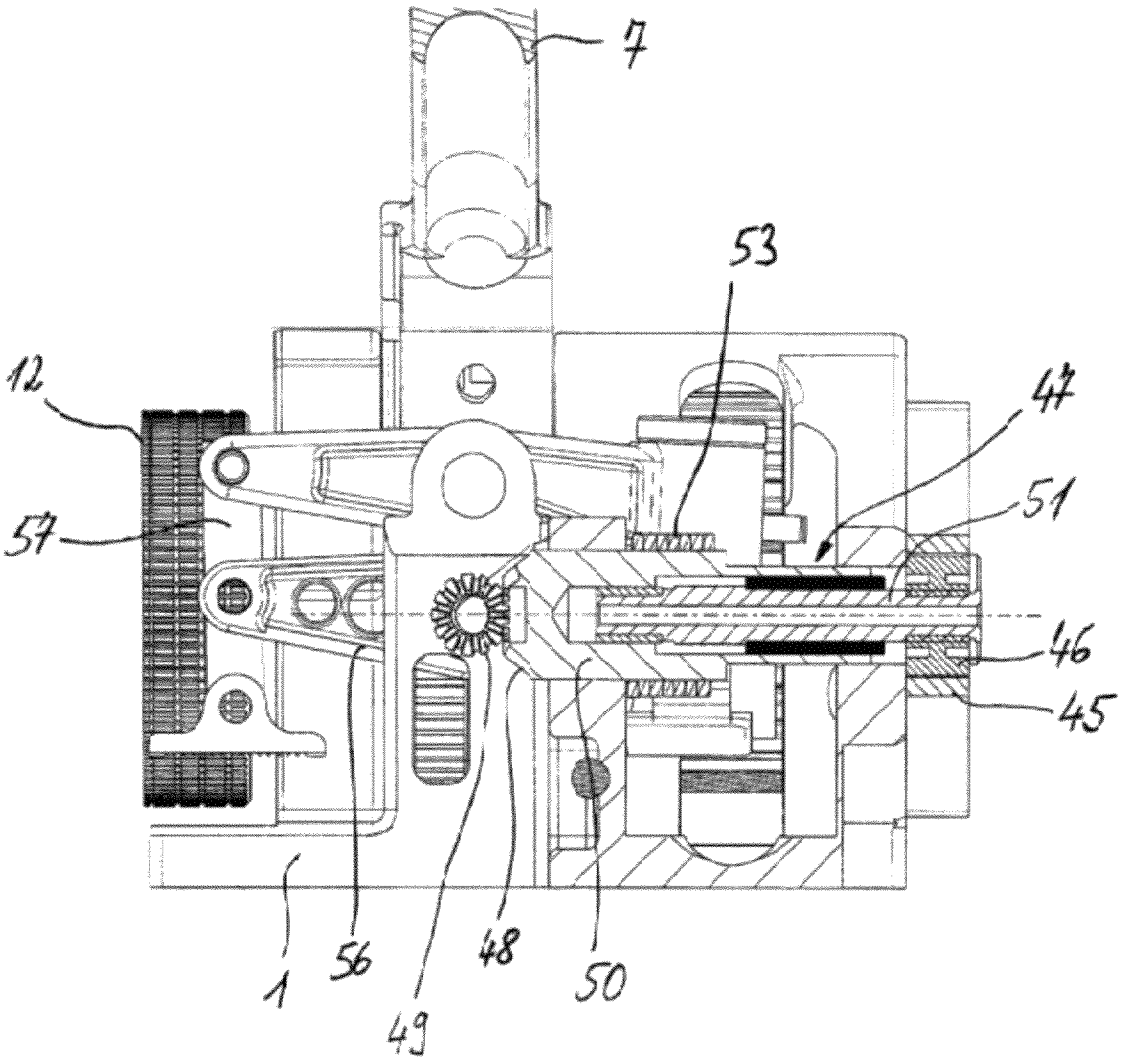
FIG. 9 shows a cross-section through the tightening device and the frictional welding device in the area of a free-wheel mechanism of a shaft.

In particular in FIGS. 2 to 7, one can recognize that an endless toothed belt that is led over a gear wheel 43 drives a pinion gear 46 of the transmission, where the pinion gear is arranged on one end of a shaft 47, on whose other front end is formed a bevel gear 48 (FIG. 9). A second bevel gear that is offset by 90° in relation to the first bevel gear 49 meshes with the first bevel gear. As is shown in FIG. 9, the shaft is built from two parts and comprises an external casing part 50, on which is formed the bevel gear 48, as well as a one-way clutch 51 that is mounted in the casing part. The one-way clutch 51 can rotate in one direction relatively to the casing part; in contrast, in the opposite direction, the two parts 50 and 51 of the shaft are splined together. Bearings for such one-way clutches are supplied, for example, by the company INA (Schaeffler KG), Herzogenaurach (DE) under the product name of Hülsenfreilauf [Sleeve-type one-way clutch] of the types HF, HFR, HFL, HFL.KF.

Figure 10:
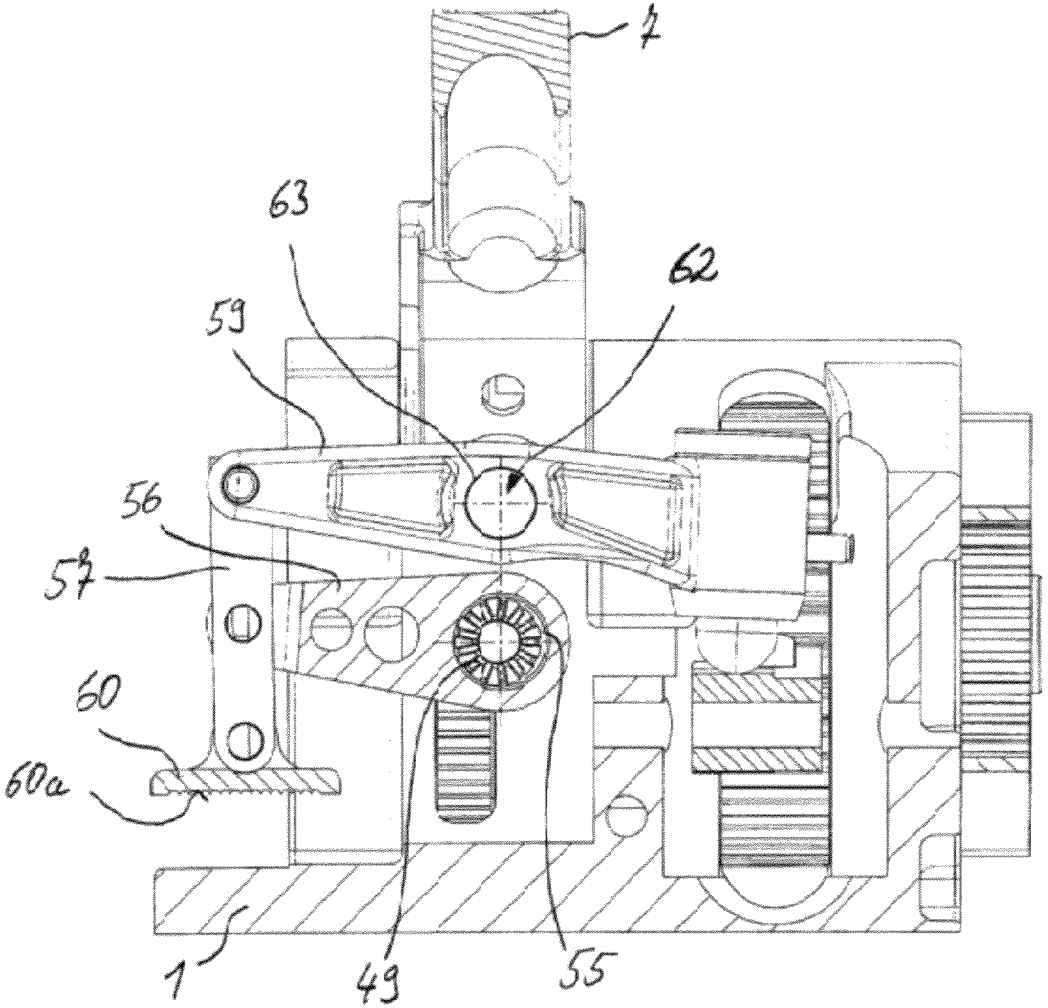
FIG. 10 shows a partial cross-section through the welding device of the strapping device.

On the external casing part 50, there is arranged a rolling spring 53, whose one end is supported by the casing or base plate and the other end is attached to the gearing rod 52. In its non-actuated position, the rolling spring 53 is adjacent with its internal surfaces to the casing part 50, which is consequently blocked against rotational movement. Using the hand lever 7, which acts on the rolling spring 53 through the gearing rod 52 (FIG. 7), one can actuate one of the two ends of the rolling spring 53 against the spring force, which expands the diameter of the rolling spring 53 and thus releases the external casing part 50 to rotate. The actuation of the rolling spring can occur, besides through the gearing rod 52, also in any other way, for example, through a latch. The welding device 5 of the strapping device is especially well illustrated in FIG. 10. As is shown in this drawing, the second bevel gear 49 sits on an eccentric shaft 54 (FIG. 7), which carries a connecting rod 56 that is arranged on an eccentric 55. The longitudinal direction of the connecting rod 56 extends transverse to the rotational axis of the eccentric shaft 54. In addition, the connecting rod 56 of the welding device is hinged to a guide bar 57. In relation of the longitudinal extension of the guide bar, the hinge spot of the connecting rod 56 is placed approximately in the middle of the guide bar 57. On its upper end (as shown in FIG. 10), the guide rod 57 is hinged to an end of an upper compression lever 59. In the area of its lower end, a hinge place is provided for a well-known frictional welding element in the form of a welding shoe 60. On all three hinges of the guide bar 57, the guide bar is hinged, in relation to the aforementioned hinged components, hinged in a pivoting or rotational mounting. The welding shoe 60 comprises on its bottom side a roughened surface structure 60*a* that is suitable for frictional welding.

In addition, the compression lever 59 is mounted in a fixed mounting spot 62, and the mounting spot 62 is located on a shaft 63 approximately in the middle of the compression lever 59. The longitudinal axes of the shaft 63 as well as the eccentric shaft 54 are located at a certain distance from each other, vertically superimposed, and extend parallel to each other. The compression lever 59 is compression spring-loaded so that the welding shoe 60 is pressed in the direction toward the strapping band. The compression lever 59, the connecting rod 56, and the guide bar 57 are arranged to each other in the form of a parallelogram.

Due to the eccentric 55, with a rotational motion of the shaft 47, the described embodiment of the welding device allows the connecting rod 56 to rise, which then results in an oscillating, to-and-fro movement of the welding shoe 60. This oscillating movement can be used to produce frictional welding.

In order to produce strapping with a plastic-material strapping material, the band is placed around the goods to be packed in the form of a band loop. In an area, where the band end overlaps with another section of the strapping band and so is arranged in two layers, the strapping band is arranged between the base plate 1 and the tensioning wheel 12 as well as the welding shoe 60. Now, the tightening wheel 12 is actuated by means of the hand lever 7. For this purpose, using the switch button 14, a positive connection is established between the ratchet pawl 16 and the clutch 18. Thus, a pivoting movement of the hand lever 7 results in a positive connection between the hand lever 7, the clutch 18, and the tensioning wheel 12. The latter is set into rotational motion and thus pulls a layer of the band backward, which leads to an increase in the band tension in the loop. In a well-known manner, the band can be fixed while maintaining its tension for the duration of the production of the frictional welding connection.

Subsequently, using the switch button 14, the positive connection of the hand lever 7 to the tensioning wheel 12 can be cancelled and established to the coil spring 11. Based on the engagement of the ratchet pawl 21 in the external toothing of the sun gear 26, a pivoting movement of the hand lever 7 now leads to a rotational motion of the gear wheels of the first planetary transmission 25. This sets the loading wheel 30 in rotation in the direction, in which the toothed belt 32 is wound on the loading wheel 30. With its attachment to the rear end of the coil spring 11, the toothed belt 32 carries along the coil spring 11. The motion of the coil spring is possible due to the one-way clutch in the shaft 47, where the one-way clutch 51 rotates in relation to the casing part 50.

By means of a pivoting movement of the hand lever, the coil spring 11 is transformed into a state, in which it has the maximum possible compression. The coil spring 11 now stores at least such amount of energy in the form of spring energy that is required to produce the welded connection. The release of the coil spring prevented by the rolling spring 53, which is not actuated at this stage and which is blocking the shaft 47 (casing part 50 and one-way clutch 51) from rotational motion. Due to the blockage in the one-way clutch of the shaft 47 in one of the two direction of motion, the entire transmission is blocked from rotational motion in the unloading direction of the coil spring 11.

In order to start the welding process, first, using the switch button 14 the two ratchet pawls 16, 21 can be released. Then the rolling spring 53 can be actuated by means of the hand lever 7, which expands their internal diameter, which results in a rotational release of the shaft 47. Thus, the entire transmission from the loading wheel 30 up to the lever mechanism of the welding device 5 is unblocked for motion. As a result, the coil spring 11 unwinds in one single constant and dead-point-free motion, the thus released energy drives the loading wheel 30, which leads to rotation of the planet gears 38 of the second planetary transmission 37. The planet gears 38 drive the sun gear 40 of the gear wheel 43. As a result, the energy flows from the toothed belt 45, through the pinion gear 46, the bevel gear transmission 60. Based on the motion of the welding shoe 60 over a, at least approximately, pre-set period of time and with an, at least approximately, pre-set frequency, a basically formerly per se well-known frictional welding connection is produced.

| List of reference numbers | |
|---|---|
| 1 | Base plate |
| 2 | Strapping band |
| 3 | Casing |
| 4 | Tightening device |
| 5 | Frictional welding device |
| 6 | Separation unit |
| 7 | Hand lever |
| 10 | Energy-storing device |
| 11 | Coil spring |
| 12 | Tightening device |
| 12a | Circumferential surface |
| 12b | Rubbing surface |
| 14 | Switch button |
| 15 | Pivoting axis |
| 16 | First ratchet pawl |
| 18 | Clutch |
| 18a | External surface |
| 18b | Rubbing surface |
| 19 | Longitudinal axis |
| 20 | Spring pack |
| 21 | Second ratchet pawl |
| 22 | Transmission device |
| 25 | Planetary transmission |
| 26 | Sun gear |
| 27 | External toothing |
| 28 | Planet gear |
| 29 | Internal toothing |
| 30 | Loading wheel |
| 31 | External surface |
| 32 | Toothed belt |
| 35 | Cover |
| 36 | Casing |
| 37 | Planetary transmission |
| 38 | Planet gear |
| 39 | Internal toothing |
| 40 | Sun gear |
| 41 | Casing part |

-continued

| List of reference numbers | |
|---|---|
| 43 | Gear wheel |
| 44 | Transmission |
| 45 | Toothed belt |
| 46 | Pinion gear |
| 47 | Shaft |
| 48 | bevel gear |
| 49 | Second ratchet pawl |
| 50 | External casing part |
| 51 | One-way clutch component |
| 52 | Gear bar |
| 53 | Rolling spring |
| 54 | Eccentric shaft |
| 55 | Eccentric |
| 56 | Connecting rod |
| 57 | Guide bar |
| 59 | Compression lever |
| 60 | Welding shoe |
| 60a | Surface structure |
| 62 | Bearing position |
| 63 | Shaft |

The invention claimed is:

1. A mobile strapping device to strap packaged goods using a strapping band, comprising:

a tightening mechanism for applying tension to a loop of a strapping band;

a frictional welding element to generate a friction weld connection of two superimposed strapping-loop segments; and a rechargeable energy-storing device for storing energy that is released as drive energy applied to a frictional welding system to produce a frictional weld connection, wherein the energy-storing device is loaded using a manually operated drive component in that, when energy stored in the energy-storing device is released, the energy-storing device carries out a displacement devoid of any reversal of motion.

2. The strapping device according to claim 1, wherein the frictional welding device comprises a manually operated lever as an actuation element, which is used to recharge the energy-storing device.

3. The strapping device according to claim 1, wherein the energy-storing device is includes a mechanical spring for the storage of energy, which during the release of energy stored in it performs a motion without reversal.

4. The strapping device according to claim 1, wherein the frictional welding shoe is driven by, at least essentially, linear movement provided by the energy-storing device.

5. The strapping device according to claim 1, wherein during the production of the friction weld connection the energy-storing device is in active connection with the transmission device, to transform an at least approximately linear and/or rotational motion without reversal that exists at the input side of the transmission into an oscillating motion.

6. The strapping device according to preceding claim 1, wherein a transmission of the transmission device to produce a gear ratio of a driving motion, where, in relation to the energy flow exiting the energy-storing device, the transmission is located between the energy-storing device and the frictional welding device.

7. The strapping device according to claim 6, wherein the transmission comprises a planetary transmission and/or a bevel gear transmission.

8. The strapping device according to claim 7, including at least two planetary transmissions.

9. The strapping device according to claim 1, wherein a driving motion of the energy-storing device is transmitted to an enveloping element, the enveloping element being a belt, a strap, a sheathed cable or a cable.

10. The strapping device according to claim 1, wherein the loaded energy-storing device is mechanically blocked against energy release by means of an element that is actuated.

11. The strapping device according to claim 1, wherein the energy-storing device is arranged, at least partially, in a handle of the strapping device.

12. A mobile strapping device to strap packaged goods using a strapping band, comprising:

a tightening mechanism for applying tension to a loop of a strapping band, and a frictional welding element to generate a friction weld connection of two superimposed strapping-loop segments, and a rechargeable energy-storing device for storing energy released as drive energy applied to a frictional welding system to produce a frictional welding connection, and a manually operated drive component, wherein at least one planetary transmission which, in relation to the path of the driving energy for the frictional welding device in the strapping direction, is arranged between a place of introduction of the driving motion and a frictional welding element of a frictional welding device that is in oscillating motion for the production of the frictional welding connection and when the energy stored in the energy-storing device is released, the energy-storing device carries out a displacement devoid of any reversal of motion.

13. The strapping device according to claim 12, wherein two planetary transmissions which, in relation to the path of the driving motion through the strapping device, are arranged one after the other.

14. The strapping device according to claim 12, including an enveloping gear with an endless enveloping element.

15. A method for the production of a frictional welding connection of two layers of a strapping band on a strapping band formed as a loop, in which a frictional welding device of a mobile portable strapping device is provided with a driving motion, which leads to an oscillating movement of a welding shoe in contact with the strapping band, comprising:

temporarily storing the energy in an energy-storing device;

actuating a release element;

transmitting the energy to the frictional welding device to produce the frictional welding connection and wherein when the energy stored in the energy-storing device is released, the energy-storing device carries out a displacement devoid of any reversal of motion.

* * * * *